United States Patent [19]

Cunnington

[11] 4,334,645

[45] Jun. 15, 1982

[54] WEB INDEXING APPARATUS AND OVERPRINTING MACHINE

[75] Inventor: Harry Cunnington, Boston, England

[73] Assignee: Norcros Investments Limited, Reading, England

[21] Appl. No.: 169,176

[22] Filed: Jul. 15, 1980

[30] Foreign Application Priority Data

Jul. 19, 1979 [GB] United Kingdom ..... 7925235

[51] Int. Cl.[3] ..... B65H 17/26

[52] U.S. Cl. ..... 226/137; 101/227

[58] Field of Search ..... 226/168, 174, 176, 181, 226/186, 187, 24, 33, 34, 35; 242/57.1; 250/571; 101/227, 218, 231, 232

[56] References Cited

U.S. PATENT DOCUMENTS

| | | | |
|---|---|---|---|
| 2,996,001 | 8/1961 | Schlegel et al. | 101/218 |
| 3,094,925 | 6/1963 | Huber | 101/227 |
| 3,176,895 | 4/1965 | Kurth | 226/176 |
| 3,887,627 | 4/1975 | Boase et al. | 226/33 |

*Primary Examiner*—Leonard D. Christian

*Attorney, Agent, or Firm*—Leydig, Voit, Osann, Mayer & Holt, Ltd.

[57] ABSTRACT

A label web overprinting machine in which the label web is indexed through the apparatus by two opposed rollers, one of which has a recess in its periphery defining a step and the other of which is movable through a small distance to form a nip for drawing the web forwardly through a printing station of the machine.

A solenoid controls the movement of the movable roller and by a machine cycle operated switch the solenoid is energized to bring the one roller into substantial contact with the other at an instant when the recess of the one roller is directed towards the other roller. Immediately the step of the roller contacts the other roller, the web is indexed forward and the solenoid is subsequently deenergized by a photo-electric cell arrangement arranged to detect a particular indicia on a label or the downstream edge of a given label.

8 Claims, 6 Drawing Figures

WEB INDEXING APPARATUS AND OVERPRINTING MACHINE

BACKGROUND OF THE INVENTION (1) Field of the Invention

This invention relates to web-indexing apparatus for use, for example, in label overprinting machines.

(2) Summary of the Prior Art

The requirement to index a web intermittently is encountered in many machines one example being self-adhesive label overprinting machines in which it is necessary to advance the web through the machine at the instant of printing by a rotary type drum. In previous proposals, in such machines the indexing of the web has been effected by purely mechanical means but such previous machines have the disadvantage that it is necessary to set-up mechanically a machine for any given run of labels on a web and this can be time-consuming and, moreover, the accuracy is not always as high as is desirable, with the result that registration is lost over a long run of labels.

As printing speeds increase and hence the velocity of the web of labels through the machine, it becomes even more essential accurately to synchronise the arrival of a given label at the printing station than in relatively low speed machines hitherto used.

SUMMARY OF THE INVENTION

According to the present invention there is provided web-indexing apparatus comprising first and second rotary members arranged to define a nip through which the web can pass, one of said rotary members having an interrupted periphery defining a step, means mounting said one rotary member for movement towards and away from the other rotary member such that when the members are brought into proximity with the interrupted periphery opposite the periphery of the other member, the step of the one rotary member will subsequently engage the web and the periphery of the other rotary member at an exact instant to thereby advance the web, solenoid means operative to bring the rotary members into and remove them from their co-operating, nip-forming, position, switch means operable in dependence upon the operational cycle of the apparatus to change the condition of the solenoid, and photo-electric cell means effective to change the condition of the solenoid in dependence upon a predetermined location on the web.

Further according to the present invention there is provided web-indexing apparatus comprising a first roller and a second roller capable of defining a nip to receive and index the web, the first said roller having an interrupted periphery defining a step, means mounting the second roller for movement towards and away from the first roller whereby the rollers can be made selectively to engage and to disengage from the web, the step of the first roller serving to initiate indexing of the web, a solenoid for controlling movement of the second roller towards and away from the first roller, switch means controllable by a continuously rotating member of the apparatus and connected in the solenoid circuit whereby to effect energization of the solenoid when the recessed part of the first roller is facing the second roller and photocell means for detecting a predetermined location of the web and connected in the solenoid circuit whereby to de-energize the solenoid when that location has been detected.

Still further according to the present invention there is provided an over-printing machine comprising reel support means for carrying a web of material to be over-printed, means for receiving the over-printed material, rotary members for advancing the web through the machine, one said rotary member having a recessed peripheral portion defining a step and the other said rotary member being arranged to co-operate with the first rotary member to advance the web through the machine, solenoid means for bringing the rotary members together, switch means connected in the solenoid circuit and arranged to energize the solenoid and photoelectric cell means operative in the solenoid circuit to deenergize the solenoid when a predetermined location on the web is reached.

DESCRIPTION OF THE PREFERRED EMBODIMENT

A description of one embodiment of web-indexing apparatus will now be given with reference to FIG. 1.

Figure 1:
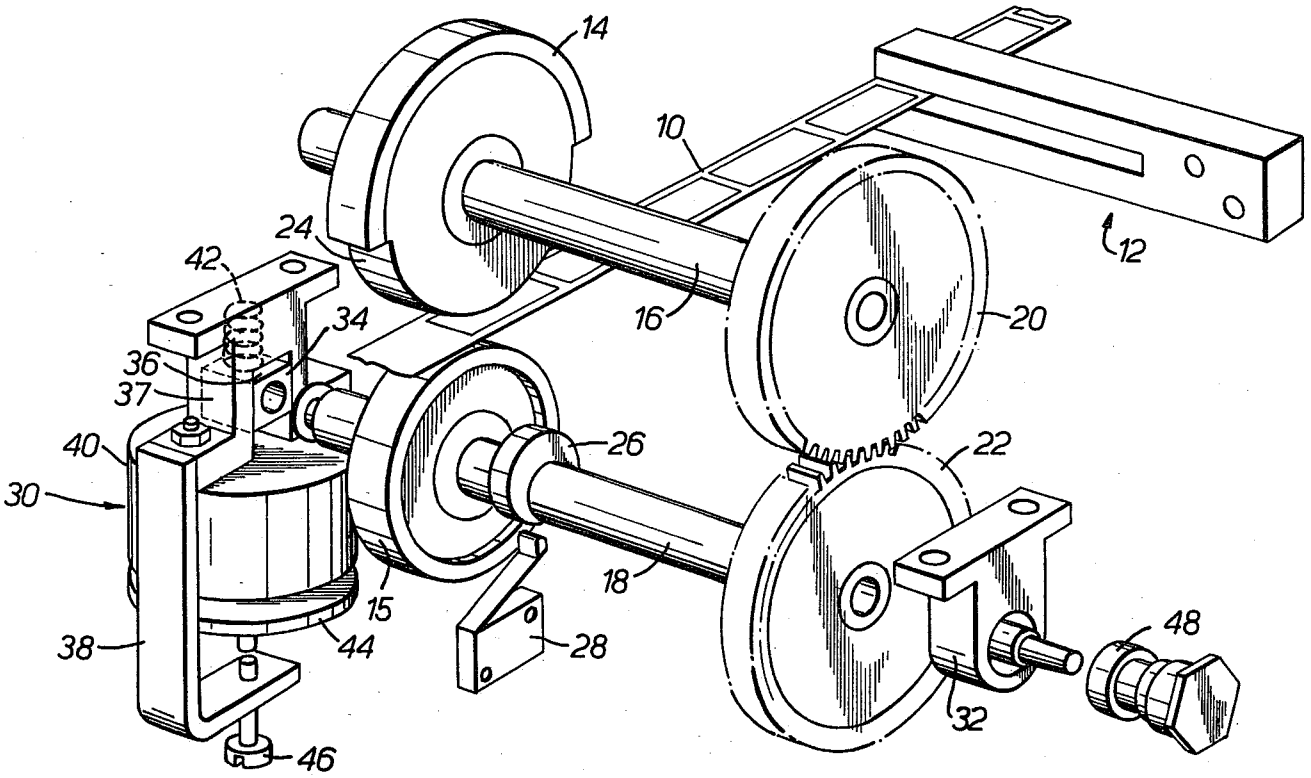
FIG. 1 is a purely diagrammatic perspective view illustrating essential components of web-indexing apparatus in accordance with the invention.

Referring now to FIG. 1, a self-adhesive label web 10 is fed to the apparatus by feed means, not shown, which may be upstream or downstream through a bracket 12 carrying a photoelectric sensing device and a corresponding light source.

The web next passes through, at a predetermined spacing downstream of the photoelectric sensing device 12, two opposed rollers 14,15 each of which is mounted on a respective transverse shaft 16,18 which carries, at an end remote from the rollers, a respective gear wheel 20,22 the two gear wheels meshing so that the rollers are driven synchronously in opposite rotational senses.

The upper roller 14 does not have a periphery of constant radius but includes a recessed portion 24 defining a step 25, while in contrast the lower roller 15 has a continuous, smooth, periphery.

The shaft 18 carrying the lower roller 15 with the continuous periphery also has keyed thereto a cam 26 which cooperates with a micro-switch 28 incorporated in the circuit of a direct-acting solenoid 30. The shaft 18 is journalled at each end in bearings 32,34, the bearing 34 being mounted in a slide member 36 capable of very limited vertical movement along vertical guides 37 rigid with a bracket 38 carrying the solenoid winding 40. The slide member 36 is biased downwardly by a spring 42 and the armature of the solenoid, when energized, exerts a force upwardly on the slide member. The winding of the solenoid is supported in the bracket 38 through a cup 44 and an adjustable stop 46.

To the right (as shown) of the bearing block 32, an eccentric bush 48 receives and supports an end portion of the shaft 18. In the assembled condition the bush is mounted in the bearing block 32 and angular adjustment of the bush enables fine adjustment of the relative positions of the shafts 16,18 when the rollers 14,15 are in the operative, engaged, condition.

In practice the adjustment will be made on assembly and the bush 48 will be locked by a grub screw (not shown).

In operation, the bottom roller 15 is moved a small distance, say a few thousandths of an inch by the solenoid 30 up into the position ready for advancing the web, during the time that the recess 24 faces the roller 15. The solenoid is in the circuit of the micro-switch 28, and the latter may be replaced by a Hall Effect switch thereby avoiding the long term unreliability of micro switches.

The web is transported forwardly instantaneously and precisely when the leading edge or step 25 of the increased diameter portion of the upper feed roller 14 acts on the lower feed roller 15 through the web.

When the photo-electric device 12 senses a gap in the labels, or a perforation in the web, or other indicia, the solenoid 30 is de-activated so that the lower feed roller 15 no longer drives the upper feed roller and hence the web through the apparatus.

When the web transporting or feed apparatus is incorporated in an overprinting machine, apparatus in accordance with the invention can be included either upstream or downstream of the printing station.

It will be appreciated that the combination of photoelectric sensing plus a mechanical system for actual transportation of the web ensures the greatest possible accuracy and also makes possible higher speeds of operation than are possible purely with mechanical systems. This higher speed may well prove to be particularly necessary whenever higher speed printing techniques, such as dot printing or spray printing, are employed in print-out arrangements of computers.

Turning now to the machine illustrated in FIGS. 2 to 5, the machine includes a base casing 100 containing part of the drive system and a superstructure 102 carrying further parts of the drive system and operational members which serve to index a web of labels through the machine and to effect printing of labels on a web.

The web progresses from right to left and a reel is carried by a reel support 104 from which the web is dispensed to two dancer rolls 106, 108 mounted for oscillatory movement on an arm 109 carried by a boom 110 extending from the base casing 100. The path of the web is indicated in chain lines and is denoted 112. The arm 109 is biased by a spring, not shown, attached to an anchorage 111 which includes provision for adjusting spring tension. After passage through the dancer rolls 106, 108, the web passes beneath a pivotal arm 114 which under its self-weight holds the label web firmly on the upper plate 116 of the casing 100.

The web then passes beneath a photo-electric cell 117 (already referred to with reference to FIG. 1) and thereafter passes between the lower roller 15 and the upper interrupted roller or cam 14 which together serve intermittently to advance the web through the machine. The web and the labels thereon next encounter a type drum 120 which cooperates with a platen roller 121 (FIG. 5) to effect printing on the successive labels at precisely the right position controlled by a Hall Effect switch cooperating with a continuously rotating shaft of the machine and with the photo-cell and associated circuitry shown in FIG. 6. Thereafter the web passes over further rollers (not shown) and is either rewound after a suitable time interval from the instant of printing or alternatively a cutting mechanism not forming part of the present invention is disposed downstream of the type drum and, in operation, the individual labels and their backing are cut and formed into a stack. The take-up reel (not shown) on the cutter mechanism (likewise not shown) is driven by a gear wheel 180 meshing with a gear wheel 181 (FIG. 5) fast for rotation with the platen roller.

Power for the machine is provided by a drive motor 130 which drives a gear train 132 through belts 134 and the gear train serves both to drive the lower roller 15 and the upper cam 14 and also through a pinion 136 drives a gear wheel 138 fast for rotation with the type drum. The cliches of the type drum 120 are inked by a transfer roller 140, the position of the spindle of which is adjustable by a screw 141 and this roller receives ink from a larger diameter roller 142 in contact with the internal roller of an ink fountain 144. The ink fountain has a single screw member 145 for adjusting the amount of ink delivered as a film of constant thickness to the rollers 142 and 140. Full details of this inking fountain are given in Ser. No. 969,966 filed Dec. 15, 1978 and now abandoned.

Means are provided to adjust the relative position of the printing platen 121 in relation to the type drum 120 and an adjustment is provided for adjustment of the take-up speed at the take-up reel (not shown).

The printing platen roller adjusting means includes a solenoid 170, the plunger 172 of which is connected a clevis 174 to a rod 176, partly screw-threaded, which in turn carries a knob 178 by which fine adjustment can be effected of the distance between the cliches and the platen 121. The solenoid 170 can also be actuated to bring the platen to the printing position and to space it away from the type drum. The shaft of the platen 121 is mounted in an eccentric bush 182 to enable fine adjustment as well as "on/off" operation to be effected. By provision of an appropriate push-button, the machine can be brought to a ready-to-print condition independently of the label web feed.

Turning now to the details of the photo-electric cell sensor 12, the photo transistor 160 which is the critical operative portion of the sensor is mounted on an arm 162 and the position of the photo transistor can be adjusted laterally of the label web while the arm itself is mounted on a screw-threaded member 164 enabling adjustment of the arm by means of a knob 166 in the length direction of the machine and of the label web.

The operating lamp for the photo transistor 160 is in the form of an infra-red wafer source and is not illustrated. It is mounted on a transverse arm (not shown) mounted for movement with the arm 162.

Figure 2:
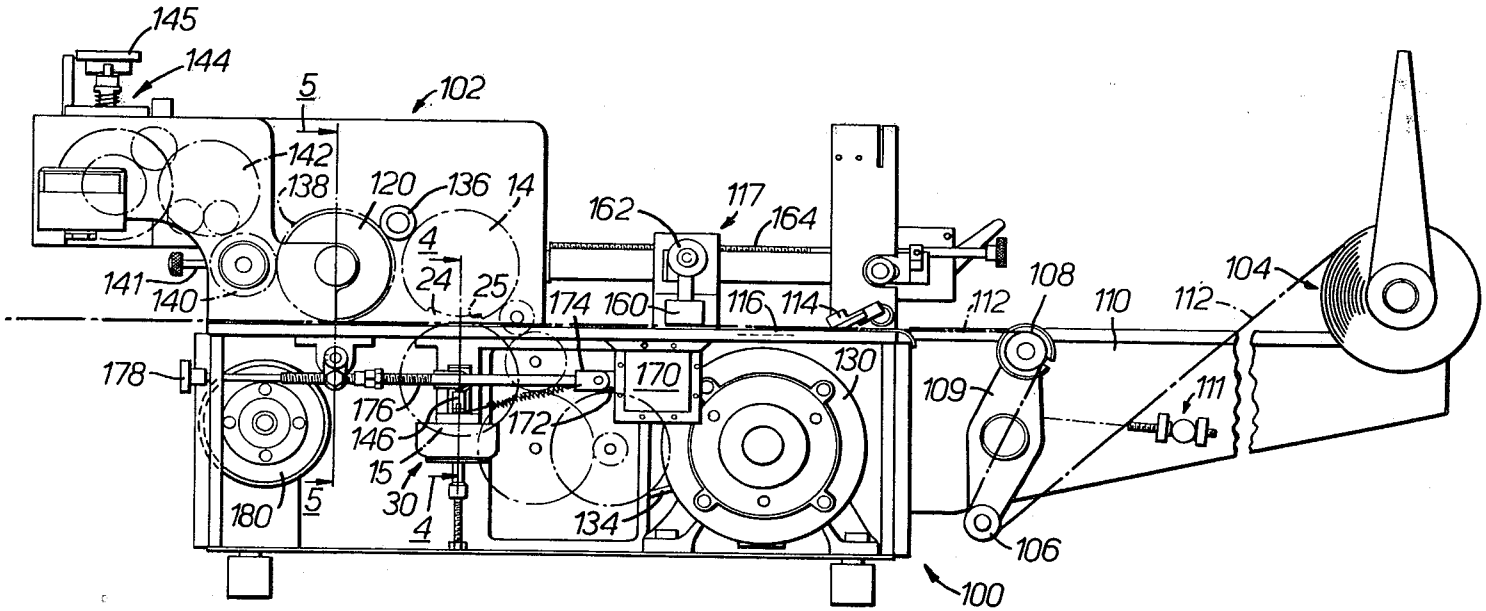
FIG. 2 is a side elevation illustrating the basic features of a label-overprinting machine incorporating web-indexing apparatus which is a modification of that illustrated in FIG. 1.
Figure 3:
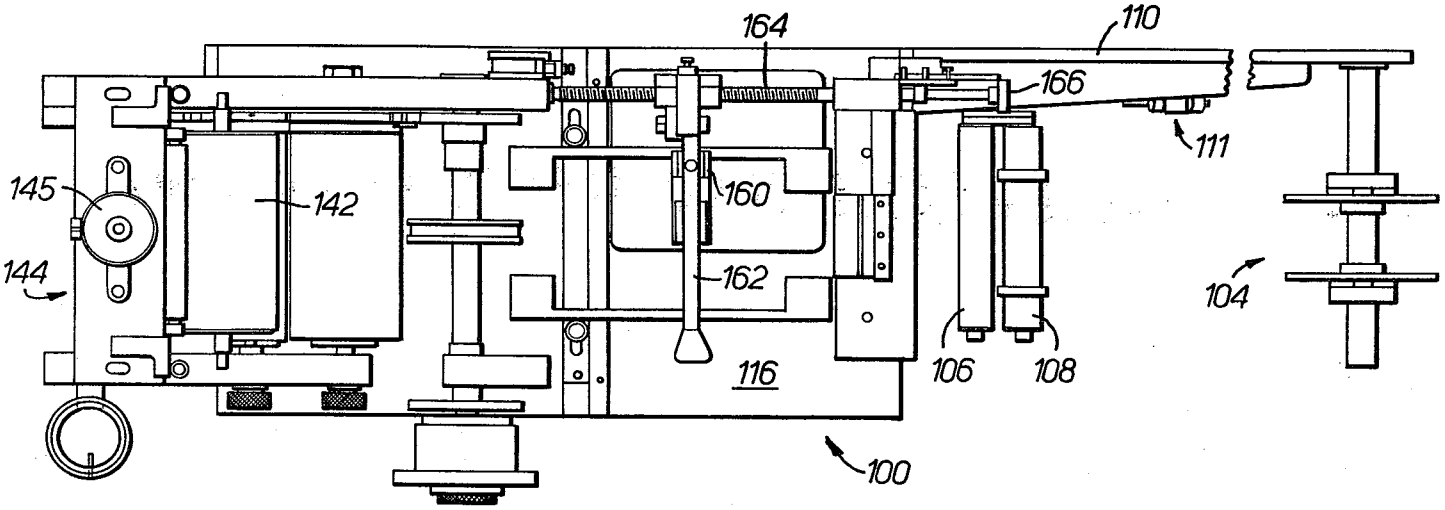
FIG. 3 is a plan view of the machine illustrated in FIG. 2.
Figure 4:
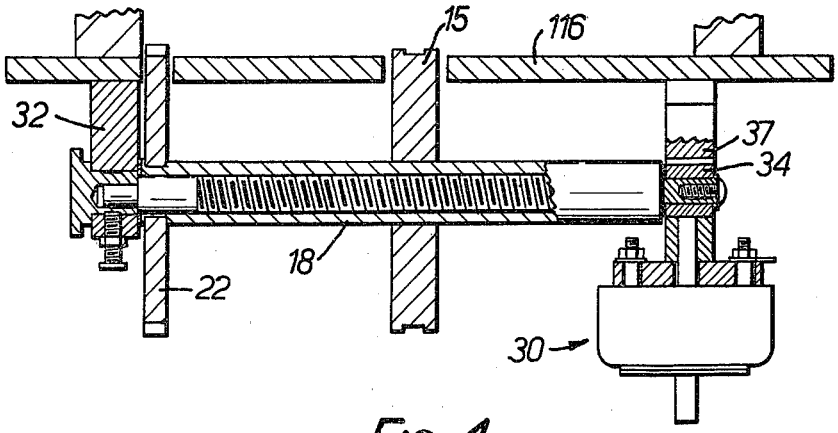
FIG. 4 is a section on the line 4—4 of FIG. 2.
Figure 5:
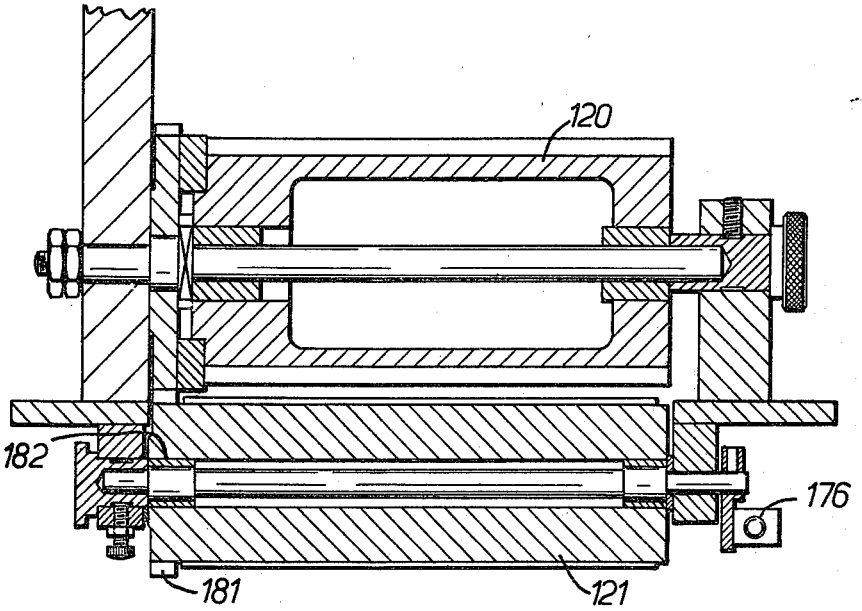
FIG. 5 is a section on the line 5—5 of FIG. 2.

As described in outline with reference to FIG. 1, immediately the micro-switch 28 or the Hall Effect switch has been energized by the motion of the corresponding shaft of the machine, the solenoid 30 is energized thereby moving the axis of the roller 15 upwardly by a short distance (of the order of a few thousandths of an inch) so that on rotation to the step 25 of the cam 14, and thereafter on the higher portion of its periphery, the web is driven through a predetermined distance and after printing effected by the type drum motion of the web ceases. As illustrated in FIGS. 2 and 4 the solenoid 30 has an armature which extends upwardly through the casing and the upper end of the armature engages one of the bearing assemblies 34 (FIGS. 1 and 4) of the roller support shaft 18 so that when energized the roller is raised through a small distance for the required period of time just before the roller engages the step and subsequently the higher periphery of the cam 14. Once a given label has passed the roller 15 or a given indicia on the label has passed, the photo transistor senses this and deenergizes the solenoid 30 allowing its armature to drop down, thereby halting transportation of the web. The cycle of operation is then resumed when the microswitch 28 on the Hall Effect switch re-energizes the solenoid 30.

Figure 6:
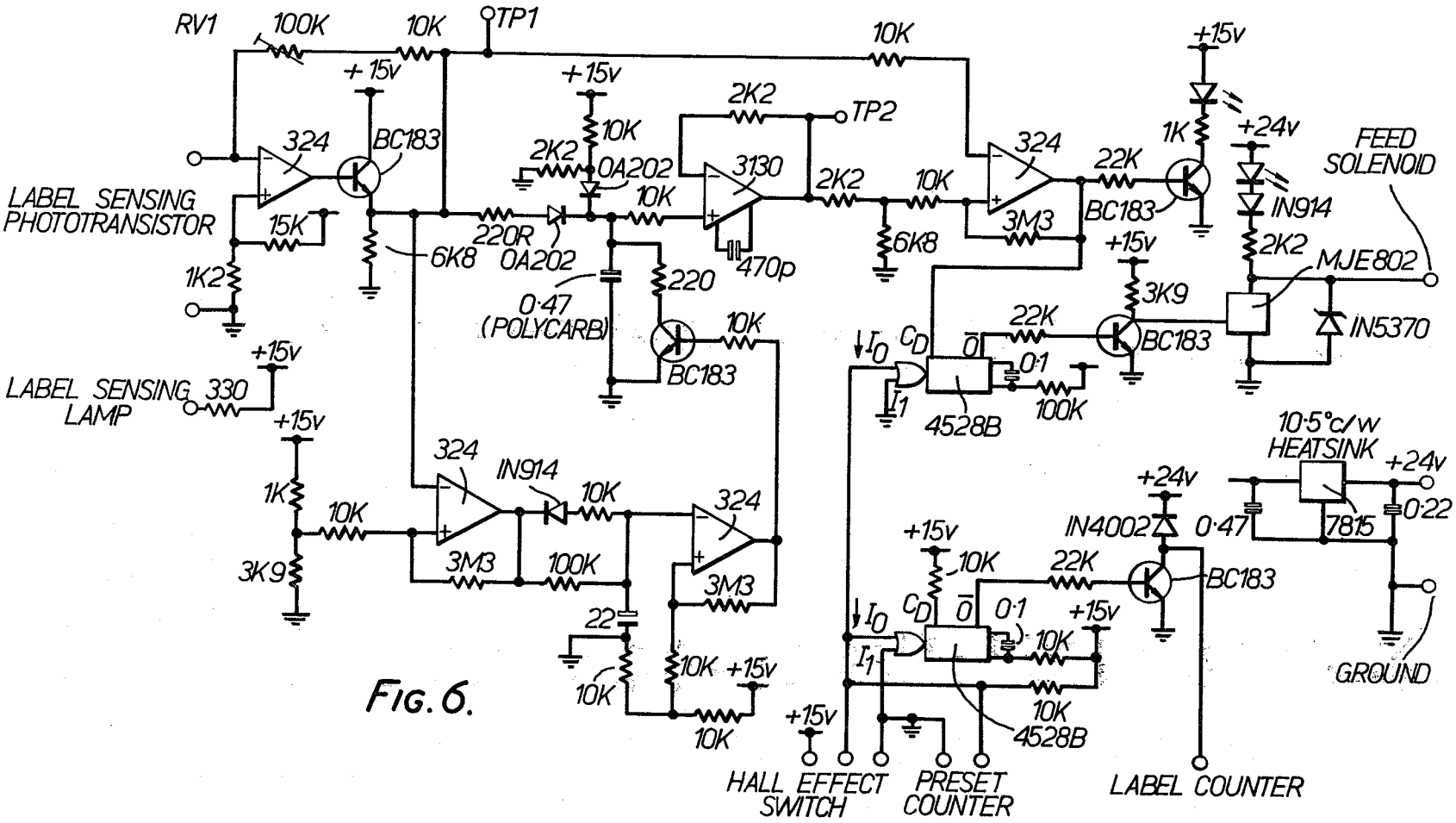
FIG. 6 is a circuit diagram illustrating the control system of the machine of FIGS. 2 to 5.

Details of the circuit providing for cooperative operation of the roller and cam arrangement 14,15 will be apparent from FIG. 6.

I claim:

1. In web-indexing apparatus, a first rotary member having an interrupted periphery defining a step, a second rotary member arranged to define a web nip in cooperation with the first rotary member, means mounting one of said rotary members for movement towards and away from the other rotary member so that when the members are brought into proximity with the interrupted periphery opposite the periphery of the other member, the step of the first rotary member will subsequently engage the web and the periphery of the second rotary member at a predetermined instant to thereby advance the web, solenoid means operative to bring the rotary members into and remove them from their cooperating, nip-forming, position, switch means operable in dependence upon the operational cycle of the apparatus to change the condition of the solenoid, and photo-electric cell means effective to change the condition of the solenoid in dependence upon a predetermined location detected on the advancing web.

2. Apparatus according to claim 1, wherein said switch means is operative to energize the solenoid whereby to bring the rotary members to the nip-forming position and the photo-electric cell means is operative to de-energize the solenoid.

3. Apparatus according to claim 1, wherein the switch means is a Hall Effect switch cooperating with a continuously rotating shaft of the apparatus.

4. Apparatus according to claim 1, comprising means mounting the photo-cell means for adjustment longitudinally and transversely of the web path.

5. Apparatus according to claim 1, wherein the photo-cell means includes a light source in the form of an infra-red wafer source.

6. In web-indexing apparatus a first roller having a peripheral recess defining a step, a second roller defining a nip with the first roller when in close proximity thereto, means mounting a second roller for movement towards and away from the first roller whereby the rollers can be made selectively to engage and to disengage from the web, the step of the first roller serving to initiate indexing of the web, a solenoid for controlling movement of the second roller towards and away from the first roller, switch means, a continuously rotating member of the apparatus controlling the switch means, the switch means being connected in the solenoid circuit whereby to effect energization of the solenoid when the recess of the first roller is facing the second roller, and photo-cell means for detecting a predetermined location of the web and connected in the solenoid circuit whereby to de-energize the solenoid when that location has been detected.

7. An over-printing machine comprising reel support means for carrying a web of material to be over-printed, means for receiving the over-printed material, rotary members for advancing the web through the machine, one said rotary member having a recessed peripheral portion defining a step and the other said rotary member being arranged to cooperate with the first rotary member to advance the web through the machine, solenoid means for bringing the rotary members together whereby to effect said web advance, switch means connected in the solenoid circuit and arranged to energize the solenoid, and photo-electric cell means operative in the solenoid circuit to de-energize the solenoid when a predetermined location on the web is detected thereby.

8. A machine according to claim 7, wherein the switch means is a Hall Effect switch.

* * * * *